United States Patent [19]

Evans et al.

[11] 4,325,691

[45] Apr. 20, 1982

[54] FURNACE INDUCTION SYSTEM

[75] Inventors: Alyce D. Evans, Shiremanstown; John R. Hilty, Thomasville, both of Pa.

[73] Assignee: Testco, Inc., Camp Hill, Pa.

[21] Appl. No.: 128,913

[22] Filed: Mar. 10, 1980

[51] Int. Cl.[3] ..... F23L 9/00

[52] U.S. Cl. ..... 431/190; 261/18 A; 431/4

[58] Field of Search ..... 431/4, 190; 123/25 R; 261/18 A, 18 B

[56] References Cited

U.S. PATENT DOCUMENTS

| | | | |
|---|---|---|---|
| 2,122,705 | 7/1938 | Welborn et al. | 48/313 |
| 3,860,384 | 1/1975 | Vulliet et al. | 431/4 |
| 3,862,819 | 1/1975 | Wentworth, Jr. | 431/4 |
| 4,009,984 | 3/1977 | Morrison | 431/4 |
| 4,014,637 | 3/1977 | Schena | 431/4 |
| 4,090,838 | 5/1978 | Schena et al. | 431/4 |
| 4,152,374 | 5/1979 | Wenger et al. | 261/24 |
| 4,173,449 | 11/1979 | Israel | 431/4 |
| 4,173,450 | 11/1979 | Schrank | 431/4 X |

*Primary Examiner*—Edward G. Favors
*Attorney, Agent, or Firm*—Thomas Hooker

[57] ABSTRACT

The combustion efficiency of oil or gas-fired furnaces is increased by flowing air through a bubble chamber and drawing the treated output into a stream of air directed into the combustion chamber so that the stream of air mixes with the flame.

8 Claims, 6 Drawing Figures

FURNACE INDUCTION SYSTEM

The invention relates to an improved furnace induction system and method whereby air is bubbled through a chamber of water with a surface layer of oil and the output is drawn by reduced pressure into a flow of air moving directly to the combustion chamber so that it mixes with the flow and is subsequently mixed with the burning fuel in the combustion chamber to enhance the efficiency of the combustion. Preferably, the bubble chamber output is drawn into the stream of air by flowing air through a venturi having a low pressure port connected to the bubble chamber output so that the output is flowed to the combustion chamber along a smooth, direct and impeller-free path.

The art has long recognized that combustion efficiency of oil or gas-fired furnaces may be increased by injecting water vapor into the combustion flame. In recent years a number of patents teach use of a water bubble chamber in furnace induction systems for treating induction air thereby improving the furnace efficiency. The bubble chamber used in the induction system of the present invention may be like the bubble chambers disclosed in U.S. Pat. Nos.: 3,862,819; 4,009,984; 4,014,637; 4,090,838; 4,152,374; and 4,173,449. In these patents, the bubble chamber output is directed to the combustion chamber through the use of centrifugal fans or blowers which provide a beaten or turbulent flow path between the bubble chamber and the combustion chamber.

Prior induction systems and methods have failed to recognize the importance of preserving the ion content in the bubble chamber output during flow of the output to the furnace and for this reason have failed to maximize combustion efficiency. The efficiency of the bubble chamber output in improving the combustion is increased by providing a direct, relatively laminar flow path from the bubble chamber to the combustion chamber without the use of an impeller for drawing the output from the bubble chamber and injecting the output into the furnace. The treated gas from the bubble chamber is pressure-drawn from the chamber to the low-pressure port of a venturi where it mixes with air flowing to the combustion chamber. The flow paths to either side of the venturi are kept short and smooth to promote laminar flow and preserve the ion content of the treated output as it is moved to the combustion chamber.

The invention is primarily intended for use with relatively large industrial or commercial furnaces having a capacity of 20 or more horsepower, although it may be used with smaller furnaces and even residential oil or gas-fired furnaces by use of a relatively smaller bubble chamber and induction system. When installed on a tuned conventional furnace, the improved induction system has the capacity for markedly increasing the efficiency of the furnace even though the total flow of treated air supplied to the flame amounts to but a few percent of the total combustion air required to sustain combustion. Efficiency increases of 13%, 18% and 20% have been achieved in furnaces ranging in size from 20 to 450 horsepower.

The induction system has been found to be most efficient when the flow through the venturi is adjusted to reduce the pressure in the bubble chamber output line by about 0.009 pounds per square inch. Depending upon the operating conditions of the individual furnace, particularly the back pressure in the combustion chamber during firing, the venturi inlet port needs to be maintained at a positive pressure of from 5 to 40 pounds per square inch in order to assure an adequate flow through the venturi to reduce the inlet line pressure for operation. Preferably, the venturi inlet pressure is in the range of from 6 to 20 pounds per square inch. Operation within these ranges maximizes the formation of humid and ionic bubble chamber output without drawing undesirable drops of water into the flame.

Other objects and features of the invention will become apparent as the description proceeds, especially when taken in conjunction with the accompanying drawings illustrating the invention, of which there are two sheets.

Figure 1:
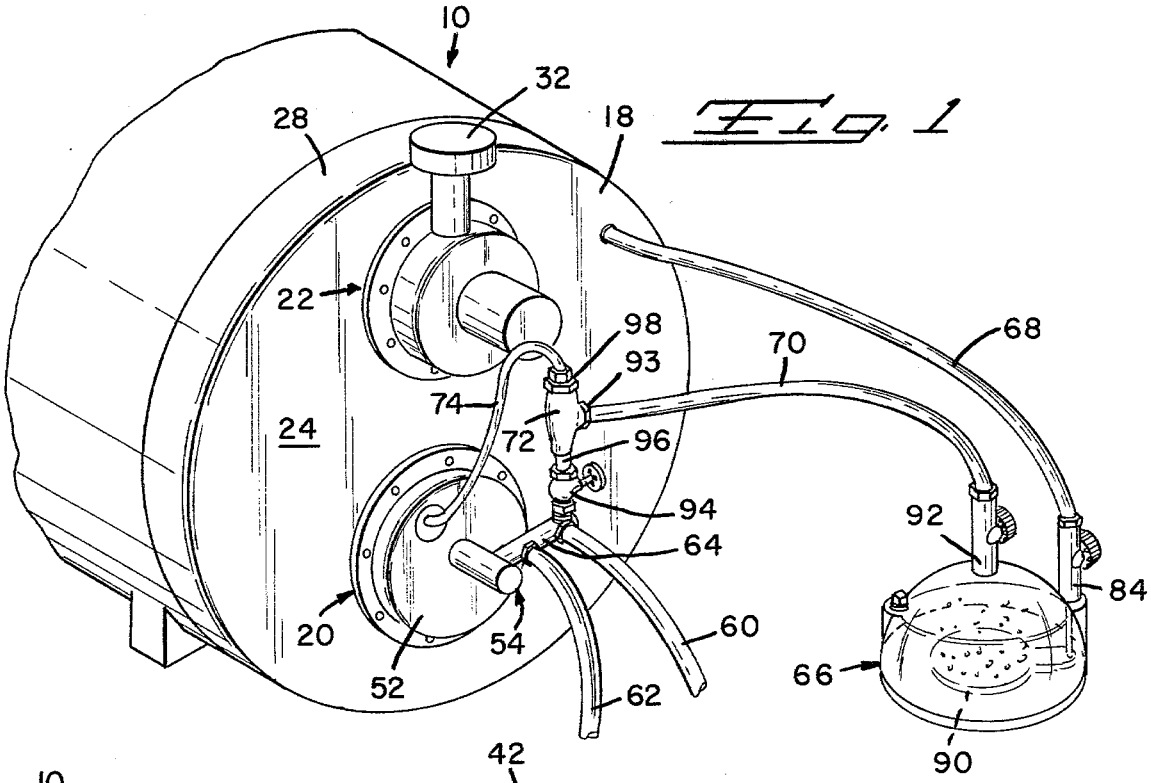
FIG. 1 is a perspective view of an oil-fired furnace with an induction system according to the invention.
Figure 2:
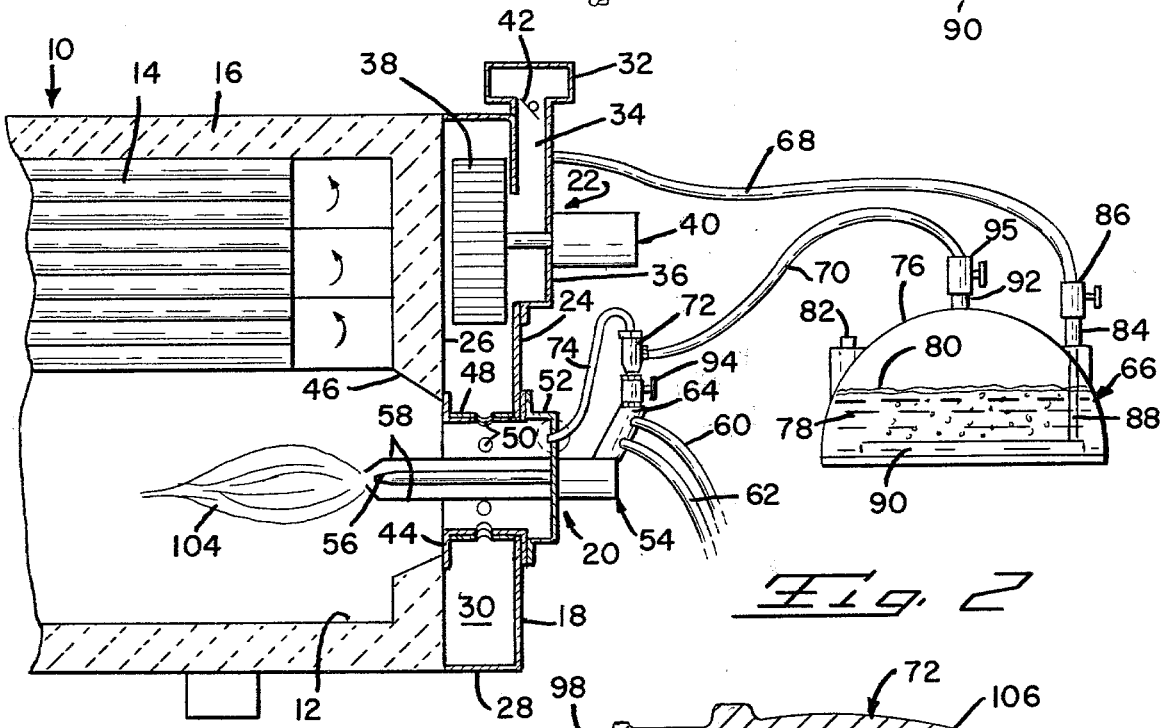
FIG. 2 is a sectional view taken through the furnace of FIG. 1.

Referring to the embodiment illustrated in FIGS. 1 through 4, furnace 10 includes a combustion chamber 12 and boiler 14 surrounded by suitable refractory walls 16. Metal cover 18 is removably mounted on one end of the furnace and supports burner assembly 20 and secondary air assembly 22. As illustrated in FIG. 1, the cover 18 includes wall 24 spaced outwardly from the end walls 26 of the furnace by sidewall 28 to define an interior volume 30 between the furnace and wall.

The secondary air assembly 22 includes an air filter 32, inlet passage 34, and cap 36 supported on cover 18. Centrifugal blower 38 driven by motor 40 is fitted within volume 30 to draw secondary air through filter 32 and blow it through volume 30 and burner assembly 20 into the combustion chamber 12. The air assembly 22 includes a damper 42 located in passage 34 for controlling the volume of secondary air supplied to the combustion chamber.

The burner assembly 20 includes a cylindrical damper member 44 mounted on furnace end wall 26 and surrounding the circular burner opening 46 formed in the end wall. The damper member 44 extends across volume 30 and is also secured to the edge of a circular opening formed in wall 24. A moveable cylindrical damper 48 overlies the member 44 and is rotatably adjustable on the member to control the volume of secondary air blown through the openings 50 formed in both members 44 and 48. A removable cap 52 is mounted on the outside of wall 24 to overlie member 44 and close the opening leading into the combustion chamber.

The cap 52 supports a conventional oil burner 54 having a nozzle 56 and ignition electrodes 58 located within the combustion chamber. Primary air line 60 and fuel oil line 62 are connected to burner intake manifold 64 so that the primary air disperses and atomizes the fuel as the air-fuel mixture is conveyed to and flowed out of nozzle 56.

The improved induction system of furnace 10 includes an air treatment chamber 66, an air inlet line 68, an air outlet line 70, a venturi 72 and a combustion chamber inlet line 74. The air treatment chamber 66 includes a sealed vessel 76 filled with a volume of water 78 having a thin layer of mineral oil 80 overlying the top of the water. Oil and water may be added to the chamber through filling port 82, as required. Air inlet port 84 includes a control valve 86 and a tube 88 extending through the wall of vessel 76 to a bubble manifold 90 on the bottom of the chamber. Manifold 90 is provided with a number of spaced bubble-forming holes so that air flowing through the inlet port and into the manifold escapes from the holes and bubbles up through water 78 and the overlying oil layer 80 into the upper portion of the vessel and is ultimately drawn from the vessel through outlet port 92 and outlet port valve 95.

Figure 3:
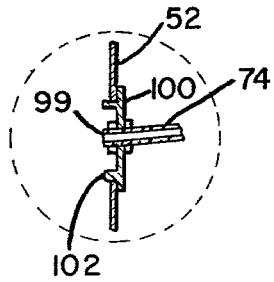
FIGS. 3 and 4 are enlarged sectional views of components of the induction system shown in FIGS. 1 and 2.
Figure 4:
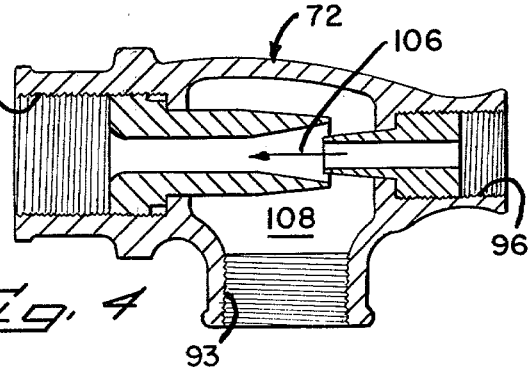

One end of air inlet line 68 is connected to the end wall 24 of cover 18 as shown in FIG. 1 and the other end of the line is connected to the inlet valve 86. One end of outlet line 70 is connected to the outlet valve 95 and the other end is connected to the low-pressure port 93 of venturi 72. As best illustrated in FIG. 1, a manually operated needle valve 94 is connected to burner manifold 64 adjacent the primary air inlet line 60 and is in fluid flow communication with primary air line 60. The outlet or downstream side of valve 94 is connected to the venturi inlet port 96. One end of the combustion chamber inlet line 74 is connected to the venturi outlet port 98 and the other end 99 of line 74 is suitably secured to an insert 100 fitted within a conventional sight hole 102 in cap 52. See FIG. 3. This way, gas flowing out port 98 and through line 74 is flowed directly into the interior of the burner assembly 20 and to the combustion flame 104. As illustrated in FIG. 3, the conventional sight glass in opening 102 has been removed and replaced by the insert 100 supporting the end 99 of line 74. If desired, the end 99 may be led through any opening in cap 52 and need not be led to the sight hole. Preferably, the end is located close to the burner to assure the flow from the induction system reaches flame 104.

Movement of air through valve 94 and venturi 72 in the direction of arrow 106 reduces the pressure in the interior space 108 thereby reducing the pressure in line 70 to draw gas from vessel 76 to the venturi. The gas is drawn into the main flow passing through the venturi and thence into the combustion chamber where it mixes with the secondary air and the flame cone to promote combustion.

The improved induction system is intended for use on previously installed furnaces to improve thermal efficiency and thereby save fuel. While a single treatment chamber 66 is illustrated in the drawings, the ability to supply treated air is limited by the size of the chamber. Large furnaces may require the use of two or more treatment chambers arranged in parallel between the input and outlet lines 68 and 70. Each chamber 66 has an optimum capacity to produce a treated output and this capacity cannot be increased by forcing more air through the chamber. Increased air flow results in churning the oil and water held within the chamber, thereby disturbing the desired upward flow of bubbles from the manifold, through the water and the restraining oil layer on the top of the water. Treated gas produced from the churned or turbulent oil-water mixture contains water droplets which undesirably inhibit combustion. The humidity and ion contact of the treated gas may also be reduced.

Following installation of the induction system with the appropriate number of treatment chambers to supply treated gas to the furnace, the furnace is tuned for optimum combustion efficiency with valves 86, 94 and 95 turned off. During tuning, it may be necessary to make conventional furnace adjustments to the primary and secondary air systems in order to attain a desired bright white flame signifying efficient combustion. After this initial adjustment has been completed, valves 84 and 92 are opened thereby allowing a portion of the air thrown outwardly by blower 38 to flow through line 68 into manifold 90 and thereafter upwardly through the water and overlying oil within vessel 76 and into line 70. A vacuum guage is attached to line 70 and the manual needle valve 94 is progressively opened to allow a flow of primary air through the valve and venturi 72 in the direction of arrow 106 and thence through line 74 to the combustion chamber where the air mixes with flame 104. Passage of the primary air through the venturi decreases the pressure within cavity 108 thereby drawing the gas from the top of chamber 76 into the venturi where it mixes with a primary flow and is directed into the combustion flame. Progressive opening of the valve 94 increases the flow through the venturi thereby decreasing the pressure within line 70 to increase the efficiency with which the treated gas from the chamber is collected and conveyed to the combustion flame.

While the combustion efficiency is increased immediately upon initial opening of valve 94 to draw the treated gas from the chamber and direct it to the combustion flame, the efficiency continues to be increased as the valve is opened sufficiently until the pressure within line 70 and the interior of the chamber about the oil and water is reduced to draw the bubble treated air to the venturi for delivery to flame 104. Optimum results are achieved when the pressure is reduced by about 0.009 pounds per square inch. Further reduction of this pressure by further opening valve 94 draws an increased amount of cool humid air, which may include water droplets, into the combustion flame thereby cooling the flame and reducing the combustion efficiency. Depending upon the back pressure in the combustion chamber, the pressure at the venturi inlet port may vary between 5 and 40 pounds per square inch in order to flow sufficient air through the venturi and generate a pressure drop for drawing treated gas to the flame. Optimum efficiency is attained with a pressure of about 6 to 20 pounds per square inch at the venturi inlet port.

After valve 94 has been properly adjusted to provide the desired optimum vacuum in line 70 and chamber 76, it will be necessary to readjust the secondary air damper 42 or damper member 48 in order to regain efficient combustion. Additional fine tuning of the dampers and valve 94 may be required to obtain optimum furnace efficiency.

During operation of the furnace and induction system, the secondary air in volume 30 is pressurized by centrifugal blower 38 and thereby flows through line 68 to vessel 76. Under optimum operating conditions, the air delivered to the manifold is under a pressure of about $\frac{1}{2}$ to 2 pounds per square inch. If air is supplied at a greater pressure, then the bubbles tend to churn the water and oil mixture with the result that the venturi draws water droplets to the flame 104. As mentioned previously, this is undesirable and decreases combustion efficiency. Excess liquid water in the combustion chamber may extinguish the flame. Valve 86 may be used to reduce the pressure of the air supplied to the manifold 90 in case of excess pressure in line 68.

When the furnace and induction system are operating optimally, the flow through line 74 comprising diverted primary air and the treated gas from chamber 66 is approximately equal to about 1.5 to 3% of the primary air flowed through oil burner 54 with the fuel and then out nozzle 56. The air supplied to manifold 90 is heated as it passes through the secondary air assembly 22 and furnace-end cover of volume 30 so that it readily picks up moisture vapor as it rises from the manifold and breaks through the overlying layer of oil 80. This air is saturated with moisture which is carried directly to the combustion zone through line 70, venturi 72 and line 74.

Bubbling of the air upwardly through the water and oil layers in chamber 66 is also believed to ionize small quantities of water so that the gas drawn from the chamber contains ions resulting from the disassociation of the water. These ions may be formed by frictional engagement between the bubbles and water as the bubbles rise through the water. Injection of the ions into the flame 104 is believed to improve the combustion efficiency of the furnace.

Bubble chambers like chamber 66 are well known in the art and it is conventional to direct the gas output of bubble chambers to furnace combustion chambers for improving combustion. In prior induction systems the bubble chamber output has been drawn to the flame by passing the output through a tortuous path, conventionally including passage through a centrifugal impeller. We have found that the efficiency of our induction system is increased by providing a direct and smooth path from the chamber 66 to the combustion chamber 12. The bubble-chamber treated gas is flowed smoothly along line 70, through the venturi 72 and then through line 74 to join the flow of secondary air moving toward flame 104. The flow through lines 70 and 74 is smooth and relatively laminar, thereby tending to preserve the ionized water vapor. The flow through the venturi is believed to result in low ion loss. The lines 70 and 74 are kept short so that the flow path from the chamber to the burner assembly 20 is as direct as possible thereby minimizing ion loss.

An induction system of the type shown in FIG. 1 was installed on a 50-horsepower Cleaver Brooks oil-fired burner. Prior to installation, the furnace was tuned for maximum efficiency. After the installation was completed, the damper 42 was adjusted for maximum efficiency as described previously. Addition of the improved induction system resulted in an improvement in efficiency of at least 20%. This increase in efficiency is believed to result from providing both highly humid air and disassociated water ions at the combustion cone, thereby improving the combustion to obtaining a greater amount of heat from a given quantity of fuel.

Figure 5:
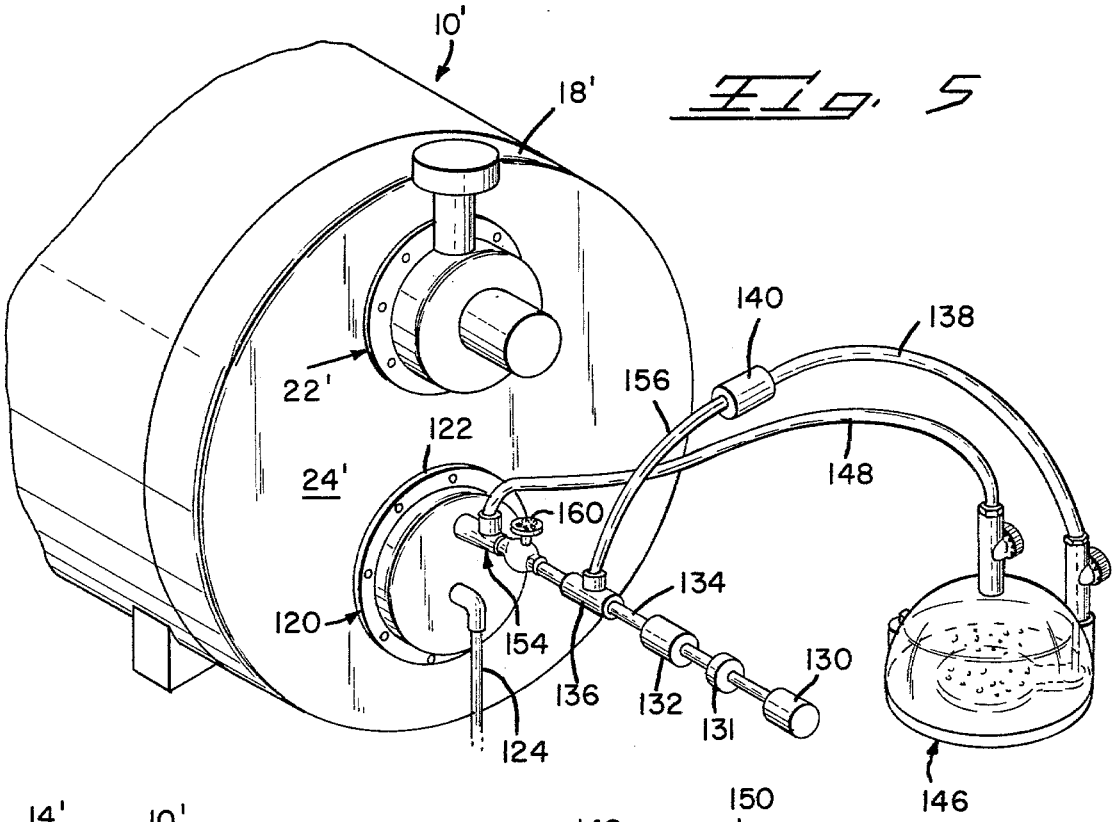
FIG. 5 is a perspective view of a gas-fired furnace with an improved induction system.
Figure 6:
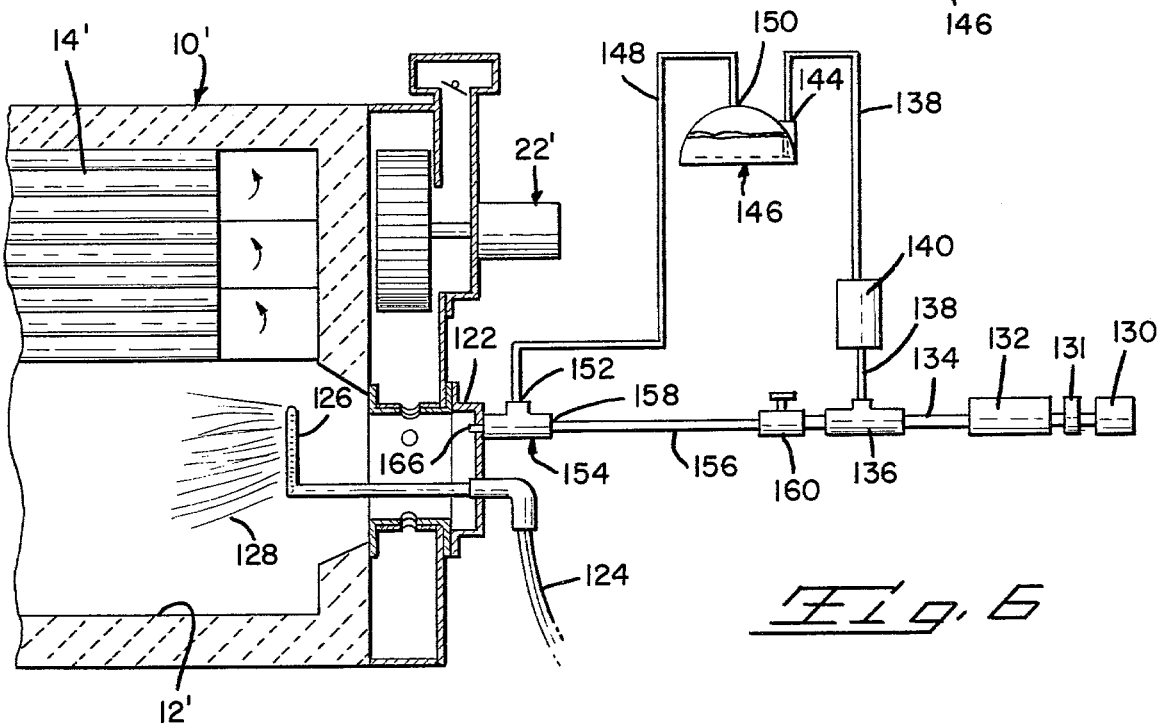
FIG. 6 is a sectional view of a furnace shown in FIG. 5.

FIGS. 5 and 6 illustrate a gas-fired furnace with an improved induction system according to the invention. Because of the similarities between the furnace and induction system of FIGS. 5 and 6 and those of FIGS. 1 through 4, the reference numbers used to describe the features of the second embodiment of the invention will be the same as those used to describe the first embodiment except they will be in prime. Thus, the furnace shown in FIG. 5 is like furnace 10 shown in FIG. 1 and is identified by reference number 10'.

Gas-fired furnace 10' includes a combustion chamber 12', boiler 14', end cover 18' and secondary air assembly 22' like those previously described in connection with the first embodiment. The gas burner assembly 120 includes a cap 122 mounted on wall 24' with a gas line 124 extending through the cap and toward the combustion chamber 12' to a perforated burner ring 126. When the furnace is fired, the secondary air assembly 22' provides a quantity of air sufficient for sustaining the combustion of the gas in flame 128.

The improved induction system for the gas-fired furnace 10' is driven by a supply of compressed air from a suitable source 130 shown diagrammatically in FIG. 6. The source 130 may be a factory compressed air line or a small air compressor unit which supplies air only to the induction system. The output of the compressed air source is connected to a solenoid controlled valve 131 which in turn is connected to unit 132. The filter regulator 132 purifies the air supplied by source 130. This air is supplied at a relatively high pressure of 100 to 120 pounds per square inch. The regulator is set to reduce this pressure to between 5 to 30 pounds per square inch and preferably to about 6 to 20 pounds per square inch so that the induction system may be easily adjusted for optimum combustion as previously described.

Line 134 extends downstream from filter regulator 132 to tee 136. A first line 138 extends from the tee to a second regulator 140 and thence to inlet port 144 of air treatment chamber 146 which is identical to the air treatment chamber 66 shown in FIGS. 1 and 2. Line 148 extends from the outlet port 150 of chamber 146 to the low-pressure port 152 of venturi 154 which may be identical to the venturi 72 shown in FIG. 2. Line 156 extends between the other outlet of tee 136 and the inlet port 158 of venturi 154. This line carries a manually operable needle valve 160 similar to valve 94 of FIGS. 1 and 2. Venturi outlet port 162 is connected directly to a bushing 166 mounted on and projecting through cap 122 so that the venturi output mixes with the secondary air and is flowed directly to flame 128.

The air treatment chamber 146 is provided with a charge of water with a mineral oil layer on top of the water as described in connection with chamber 66. It includes a bubble manifold connected to the inlet port so that air flowing through line 138 bubbles up through the water and oil into the upper volume of the chamber and is drawn through the outlet port 150 and line 148 to the venturi 154. The regulator 140 is set to lower the pressure of the air flowing into the inlet port to about ½ to 2 pounds per square inch.

FIGS. 5 and 6 do not illustrate the ignition system used to initially fire furnace 10'. This system includes conventional electrodes which extend into the combustion chamber 12' for igniting flame 128. The solenoid in valve 131 is connected to the electrical system so that air from source 130 is automatically turned on when the furnace is fired and is turned off when the flame is extinguished.

Following installation of the improved induction system in gas-fired furnace 10', the system is deactivated and the furnace is tuned for maximum efficiency. Then, the system is activated, the controls 132 and 140 and valve 160 are adjusted to provide a suitable flow through the venturi 154 and a suitable pressure for the air supplied to the chamber 146 through inlet port 144. As in the first embodiment of the invention, the pressure at the venturi inlet port may be between 5 and 30 pounds per square inch and is preferably between 6 to 20 pounds per square inch. Air flowing into port 144 is at a pressure between ½ and 2 pounds per square inch. Negative pressure in line 148 is preferably approximately 0.009 pounds per square inch.

Once the induction system has been suitably tuned, it may be necessary to again adjust the secondary air damper of furnace 10' because of the additional air supplied through the venturi. This may require a reduction of the secondary air supplied through assembly 22'. Successive fine tunings of the induction system and furnace will result in an efficient blue flame 128 with the induction system in operation and supplying efficiency-enhancing treated air to the flame 128. It is believed that the combustion of this flame is enhanced by the treated air from chamber 146 in exactly the same way that the combustion of flame 104 is enhanced by the treated air received from chamber 66. As in the embodiments of FIGS. 1 and 2, lines 148 and 162 are preferably kept at a minimum length to provide a direct and smooth flow path from the chamber 146 to the combustion chamber, thereby minimizing ion loss. An improved induction system as shown in FIGS. 5 and 6 was installed in a Keeler vertical draft gas-fired boiler. This furnace required a pair of chambers 146 connected in parallel as described previously. Following installation of the improved induction system, the combustion efficiency was increased about 18%.

While we have illustrated and described the preferred embodiments of our invention, it is understood that these are capable of modification, and we therefore do not wish to be limited to the precise details set forth, but desire to avail ourselves of such changes and alterations as fall within the purview of the following claims.

What we claim our invention is:

1. An induction system for injection of a treated combustion gas into the combustion zone of a furnace having a combustion chamber, a fuel burner within the combustion chamber and a source of air having a pressure greater than the pressure within the combustion chamber during firing, the system comprising an air flow line extending from the source of air to the combustion chamber and having an end opening into the combustion chamber adjacent the combustion zone; a bubble chamber for bubbling air through a liquid to form a treated output gas, the bubble chamber including an inlet port and an outlet port; a venturi located within the air flow line adjacent the end of the line opening into the combustion chamber, the venturi including an inlet port, an outlet port and a low-pressure port, the inlet and outlet ports both located within the air flow line with the outlet port located closely adjacent the end of the line opening into the combustion zone so that air flows from the source through the venturi and into the combustion zone; a flow control device located in said line upstream of the venturi operable to restrict the flow of air through the line and venturi to the combustion chamber; and a gas flow line connecting the outlet port of the bubble chamber with the low-pressure port of the venturi whereby the flow of air from the source and through the venturi lowers the pressure at the low pressure port and pressure-draws the treated output gas from the bubble chamber into the venturi to mix nonmechanically with the flow of air delivered to the combustion zone and thereby improve combustion.

2. An induction system as in claim 1 wherein the furnace includes a secondary air source and an input line extends from the secondary air source to the bubble chamber inlet port.

3. An induction system as in claim 1 wherein the pressure at the venturi low-pressure point is reduced by about 0.009 pounds per square inch.

4. An induction system as in claim 1 wherein the flow control device comprises an adjustable valve so that the flow through the venturi and the resultant pressure drop at the low-pressure port may be adjusted with variation in furnace back pressure.

5. An induction system as in claim 4 wherein the pressure at the venturi low-pressure point is reduced by about 0.009 pounds per square inch.

6. An induction system as in claim 5 wherein the pressure at the venturi inlet port is between about 5 to 40 pounds per square inch.

7. An induction system as in claim 6 wherein the venturi outlet port is mounted directly on the furnace and opens into the combustion chamber.

8. An induction system as in claim 5 wherein the gas flow line and the portion of the air flow line from the venturi to the combustion chamber define a smooth and generally laminar flow path for the treated output gas.

* * * * *